US006292971B1

(12) United States Patent
Chaudray

(10) Patent No.: US 6,292,971 B1
(45) Date of Patent: Sep. 25, 2001

(54) POWER CLEANING BRUSH

(76) Inventor: Muhammad I. Chaudray, 13159 Tory Loop, Woodbridge, VA (US) 22192

( * ) Notice: Subject to any disclaimer, the term of this patent is extended or adjusted under 35 U.S.C. 154(b) by 0 days.

(21) Appl. No.: 09/206,303

(22) Filed: Dec. 7, 1998

(51) Int. Cl.[7] ..... A46B 13/04; A46B 15/00
(52) U.S. Cl. ..... 15/29; 15/23; 15/24; 15/22.1
(58) Field of Search ..... 15/22.1, 23, 24, 15/28, 29

(56) References Cited

U.S. PATENT DOCUMENTS

| | | | |
|---|---|---|---|
| D. 169,115 | | 3/1953 | Turner . |
| D. 346,698 | | 5/1994 | Hinnant . |
| 750,357 | * | 1/1904 | Gibbons . |
| 2,778,043 | | 1/1957 | Arf . |
| 3,024,883 | | 3/1962 | Eriksson . |
| 4,208,753 | * | 6/1980 | Lewis . |
| 4,461,052 | * | 7/1984 | Mostul . |
| 4,780,992 | * | 11/1988 | McKervey . |
| 5,423,102 | * | 6/1995 | Madison . |
| 5,636,400 | | 6/1997 | Young . |
| 5,960,503 | * | 10/1999 | Mattei . |

* cited by examiner

*Primary Examiner*—Deborah Jones
*Assistant Examiner*—Jennifer McNeil
(74) *Attorney, Agent, or Firm*—Patent & Trademark Services; Joseph H. McGlynn

(57) ABSTRACT

A powered cleaning brush for cleaning toilet bowl which has at handle with a source of electricity connect thereto. In addition the handle has a container for holding a cleaning solution and a trigger for supplying cleaning solution to the brush. The handle has an angled portion for enabling a user to clean under the rim of the toilet bowl and for cleaning the angled drain on the toilet. The trigger is positioned on the opposite side of the handle from the angled portion to make positioning the brush convenient for the user.

1 Claim, 1 Drawing Sheet

POWER CLEANING BRUSH

BACKGROUND OF THE INVENTION

This invention relates, in general, to cleaning brushes, and, in particular, to a powered cleaning brush for toilets.

DESCRIPTION OF THE PRIOR ART

In the prior art various types of cleaning brushes have been proposed. For example, U.S. Pat. Nos. Des. 169,115 and Des. 346,698 to Turner and Hinnant disclose brushes with soap dispensers built into the handle.

U.S. Pat. No. 2,778,043 to Arf discloses an electrically operated brush.

U.S. Pat. No. 3,024,883 to Eriksson discloses an electrically operated brush having a trigger operator.

U.S. Pat. No. 5,636,400 to Young discloses a battery operated cleaning brush.

SUMMARY OF THE INVENTION

The present invention is directed to a powered cleaning brush for cleaning toilet bowl which has a handle with a source of electricity connect thereto. In addition the handle has a container for holding a cleaning solution and a trigger for supplying cleaning solution to the brush. The handle has an angled portion for enabling a user to clean under the rim of the toilet bowl and for cleaning the angled drain on the toilet. The trigger is positioned on the opposite side of the handle from the angled portion to make positioning the brush convenient for the user.

It is an object of the present invention to provide a powered cleaning brush for a toilet.

It is an object of the present invention to provide a powered cleaning brush for a toilet which has an angled handle to make cleaning under the rim of the toilet convenient.

It is an object of the present invention to provide a powered cleaning brush for a toilet which has a detergent container mounted on the handle of the brush.

These and other objects and advantages of the present invention will be fully apparent from the following description, when taken in connection with the annexed drawings.

DESCRIPTION OF THE PREFERRED EMBODIMENT

Figure 1:
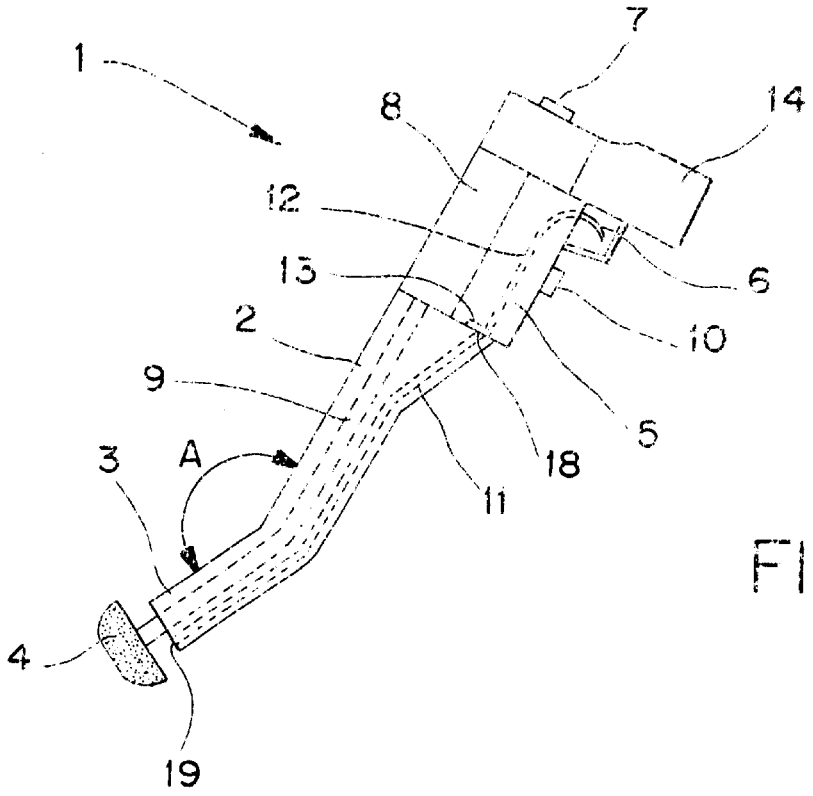
FIG. 1 is a side view of the present invention.
Figure 2:
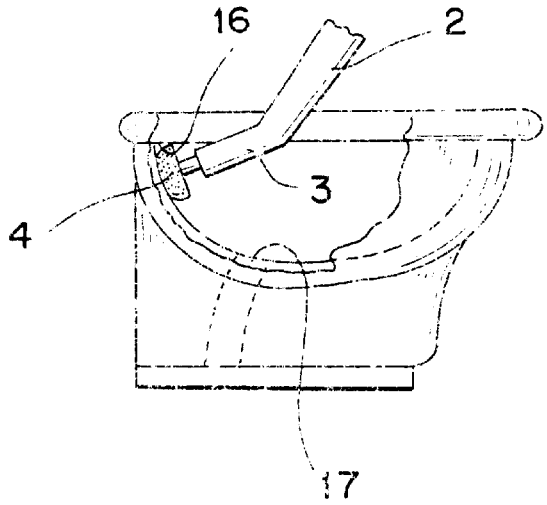
FIG. 2 is a partial view of the present invention showing the brush being used to clean the under side of the toilet rim.

Referring now to the drawings in greater detail, FIG. 1 shows the powered cleaning brush 1 of the present invention. The device has a handle which has a rechargeable batter 14 connected thereto. The battery 14 is electrically connected to an on/off switch 7 which will turn on and off the motor 8. The motor 8 is connected by a shaft 9 to a brush 4 which will be used to clean the toilet as shown in FIG. 2. It should be noted that although the preferred method of operating the brush is with a rechargeable battery, this is not the only method that can be used. The brush could also be operated by using a conventional electrical plug (not shown) which would plug into a conventional 110 volt electrical outlet. Also, the switch 7 used with the present invention could be any type of conventional switch which will turn the electrical power from the source of power to the motor 8 on and off. Since the electrical connections from either a rechargeable battery or from a conventional 110 volt socket to a motor are conventional and well known in the art no further description is necessary.

The brush 4, as shown in FIG. 1 has a curved side edge and a relatively flat front face which, as shown in FIG. 2, will conform to the underside of the toilet rim 16. This will ensure that the user will reach all the portions of the underside of the toilet rim and will clean this area properly. This is also true of cleaning the drain 17, which slopes slightly towards the back of the toilet, as shown in FIG. 2. The angle A as shown in FIG. 1, which should be greater than 90° and less than 180°, places the brush head 4 at a convenient angle for the user to hold the powered brush with their finger on the trigger 6, which will release cleaning detergent from the container 5, through the tube 11, to the brush 4.

As clearly seen in FIG. 1, the handle of the powered brush 1 has a two portion handle 2 and 3. The two portions are angled with respect to each other, as defined above. and the brush 4 is on the opposite side of the powered brush from the trigger 6. This arrangement will allow a user to hold the powered brush in a convenient position so that they can squeeze the trigger, allowing cleaning solution to be dispensed to the brush 4, and at the same time can press the brush 4 up, under the rim 16 of the inside of the toilet. This makes it easier to apply pressure against the underside of the rim to clean off any stubborn stains. If the handle portions 2, 3 were straight it would be much harder for a user to apply pressure with the brush 4 to the under side of the rim 16, since the user would have to twist the powered brush in an unnatural angle to reach the underside of the rim. The angle A also makes it easier to clean the toilet drain 17 since this drain extends toward the back of the toilet at an angle, as shown in FIG. 2. Due to the angle A and the placement of the brush 4 on the opposite side of the powered brush from the trigger 6, the user can more easily apply pressure in order to clean the underside of the rim and the drain of the toilet.

In order to supply cleaning detergent to the brush 4, a container 5 is used to hold such a cleaning detergent. An opening, which has a stopper 10 that an be removed, allows a user to fill the container 5 with any type of cleaning detergent. When the user wants to apply detergent to the brush 4 he/she merely has to pull the trigger 6. The trigger 6 is connected to a shaft 12, which in turn is connected to a flap 13 which normally covers and seals the opening 18 so detergent can not move from the container 5 to the supply tube 11. When the trigger 6 is pulled, the flap 13 is lifted so that detergent may flow from the container 5, through the supply tube 11, to the brush 4 via opening 19.

The powered brush has an on/off switch 7 which can be any conventional switch and which will turn on or off the motor 8. The motor 8 is connected to the brush 4 by means of a drive shaft 9. When the motor is turned on, the brush 4 will rotate and, after being supplied with cleaning solution from the container 5, as explained above, the user will be able to use the revolving brush to easily and conveniently clean all parts of the toilet.

Although the Powered Cleaning Brush and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A powered cleaning brush comprising:

a handle having first and second ends and defining first (2) and second (3) portions, said first (2) and second (3) portion being fixed at an angle (A) of more than 90 degrees and less than 180 degrees, a rotating brush connected to said second end of said handle, a motor attached to said first end of said handle, means for supplying electrical power to said brush for rotating said brush, means for supplying detergent to said rotating brush, and wherein said means for supplying detergent to said rotating brush comprises a container, said container is mounted on the first end of said handle adjacent and in contact with said motor, a tube connected between said container and said rotating brush, said container having an aperture between said container and said tube, a flap for covering said aperture, means for moving said flap from a first position in which said flap covers said aperture and preventing detergent from moving from said container to said tube, to a second position in which said flap does not cover said aperture and allows detergent to move from said container to said tube, and wherein said means for moving said flap from said first position to said second position is connected to said first end of said handle and on a surface opposite from said angle (A).

* * * * *